US008020531B2

(12) United States Patent
Maehara et al.

(10) Patent No.: US 8,020,531 B2
(45) Date of Patent: Sep. 20, 2011

(54) ELECTRONIC THROTTLE CONTROL DEVICE IN V-TYPE INTERNAL COMBUSTION ENGINE FOR VEHICLE

(75) Inventors: Hayato Maehara, Saitama (JP); Kazuhito Hotta, Saitama (JP); Takaaki Tsukui, Saitama (JP); Masanobu Urabe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 573 days.

(21) Appl. No.: 11/902,920

(22) Filed: Sep. 26, 2007

(65) Prior Publication Data

US 2008/0078355 A1 Apr. 3, 2008

(30) Foreign Application Priority Data

Sep. 29, 2006 (JP) ..... 2006-270000

(51) Int. Cl.
*F02D 11/10* (2006.01)

(52) U.S. Cl. ..... 123/399; 123/336

(58) Field of Classification Search ..... 123/336, 123/337, 308, 432, 296, 399, 400, 403, 442, 123/478, 583; 215/305; 180/170, 219
See application file for complete search history.

(56) References Cited

U.S. PATENT DOCUMENTS

| | | | | |
|---|---|---|---|---|
| 5,606,949 | A | 3/1997 | Ohara et al. | |
| 6,105,562 | A * | 8/2000 | Akagi et al. | 123/580 |
| 7,219,657 | B2 * | 5/2007 | Hotta et al. | 123/468 |
| 2004/0069271 | A1 | 4/2004 | Kanno et al. | |
| 2004/0244768 | A1 * | 12/2004 | Udono | 123/336 |
| 2005/0155571 | A1 * | 7/2005 | Hanasato | 123/336 |
| 2005/0211220 | A1 | 9/2005 | Matsuda | |
| 2006/0042589 | A1 * | 3/2006 | Hanasato | 123/336 |

FOREIGN PATENT DOCUMENTS

| | | | |
|---|---|---|---|
| DE | 10 2006 011 679 | A1 | 9/2006 |
| EP | 0 456 225 | A1 | 11/1991 |
| EP | 1 550 802 | A1 | 7/2005 |
| JP | 2006-42446 | A | 2/2006 |
| JP | 2006-250083 | A | 9/2006 |

* cited by examiner

*Primary Examiner* — Willis R Wolfe, Jr.
*Assistant Examiner* — Johnny H Hoang
(74) *Attorney, Agent, or Firm* — Birch, Stewart, Kolasch & Birch, LLP

(57) ABSTRACT

An electronic throttle control device in a internal combustion engine for a vehicle can be improved in maintainability and can be reduced in size. An electronic throttle control device in a V-type internal combustion engine for a vehicle has a fuel injection valve and throttle valves in an intake passage. A throttle driving motor controls the opening angle of each throttle valve according to the amount of operation of a throttle grip performed by an operator of the vehicle. The throttle driving motor is located outside a region surrounded by the throttle bodies that are respectively connected to all of intake ports as viewed in plan.

15 Claims, 9 Drawing Sheets

ELECTRONIC THROTTLE CONTROL DEVICE IN V-TYPE INTERNAL COMBUSTION ENGINE FOR VEHICLE

CROSS-REFERENCE TO RELATED APPLICATIONS

This nonprovisional application claims priority under 35 U.S.C. §119(a) on Patent Application No. 2006-270000, filed in Japan on Sep. 29, 2006, entirety of which is incorporated herein by reference.

BACKGROUND OF THE INVENTION

1. Field of the Invention

The present invention relates to an electronic throttle control device in a V-type internal combustion engine for a vehicle. More particularly, the present invention relates to an electronic throttle control device, wherein the amount of operation of the throttle by an operator of the vehicle is electrically detected by a sensor. Also, an electrical output based on a detection signal from the sensor is fed through a wire to a throttle driving motor provided in the vicinity of a throttle valve, whereby the opening angle of the throttle valve is controlled by the power from the throttle driving motor.

2. Background of the Invention

In an internal combustion engine for a vehicle including an electronic throttle control device, a throttle driving motor for driving a plurality of throttle valves is located at a substantially central position of the internal combustion engine as viewed in plan (For example, see Japanese Patent Laid-Open No. 2006-42446).

The internal combustion engine for the vehicle disclosed in Japanese Patent Laid-Open No. 2006-42446 is an in-line four-cylinder internal combustion engine having four throttle bodies respectively connected to the four cylinders. The throttle bodies are fixedly mounted on a cylinder head so as to be pointed obliquely upward. A plurality of throttle shafts for respectively supporting the throttle valves are arranged in a line and are axially connected with each other along the cylinder train. The throttle driving motor is located adjacent to the upper end of any one of the throttle bodies at the center of the cylinder train. A drive shaft of the throttle driving motor is connected through a speed reduction gear train to any one of the throttle shafts. Accordingly, there is a possibility that an air cleaner for supplying air through the throttle valves into the cylinders may interfere with the throttle driving motor, which is located at a high position, and a large-diameter input gear of the speed reduction gear train. Therefore, the air cleaner is spaced apart from a cylinder head cover of the internal combustion engine, causing a problem in that a size reduction of the internal combustion engine is difficult.

SUMMARY OF THE INVENTION

It is accordingly an object of the present invention to provide an electronic throttle control device in a V-type internal combustion engine for a vehicle, which can be improved in maintainability and can be reduced in size.

In accordance with a first aspect of the present invention, an electronic throttle control device in a V-type internal combustion engine for a vehicle is provided. The V-type internal combustion engine has a fuel injection valve 20 and throttle valves 11 in an intake passage. A throttle driving motor 31 controls the opening angle of each throttle valve 11 according to the amount of operation of the throttle performed by an operator of the vehicle. The throttle driving motor 31 is located outside a region X surrounded by the throttle bodies 10 that are respectively connected to all of the intake ports 9 as viewed in plan.

In accordance with a second aspect of the present invention, the fuel injection valves are located inside the region X surrounded by the throttle bodies 10 that are respectively connected to all of the intake ports 9 as viewed in plan.

In accordance with third aspect of the present invention, the throttle driving motor includes a single throttle driving motor that is connected to a first throttle shaft for supporting at least one of the throttle valves in the first bank. The first throttle shaft is connected through a link to a second throttle shaft for supporting at least one of the throttle valves in the second bank.

In accordance with a fourth aspect of the present invention, the throttle driving motor includes a first throttle driving motor connected to a first throttle shaft for supporting at least one of the throttle valves in the first bank, and a second throttle driving motor connected to a second throttle shaft for supporting at least one of the throttle valves in the second bank.

In accordance with a fifth aspect of the present invention, the throttle driving motor comprises: a first throttle driving motor connected to a first throttle shaft for supporting at least one of the throttle valves in the first bank; and a plurality of second throttle driving motors respectively connected to a plurality of second throttle shafts for respectively supporting at least two of the throttle valves in the second bank.

According to the first aspect of the present invention, the throttle driving motor is located outside the region surrounded by all of the throttle bodies that are respectively connected to all of the intake ports as viewed in plan. Accordingly, the maintenance of a throttle valve driving system can be performed easily and efficiently without interference with the nearest throttle body. Furthermore, an intake passage can be made substantially straight due to the specific location of the throttle driving motor, so that an intake resistance can be reduced to improve the charging efficiency of intake air.

According to the second aspect of the present invention, all of the fuel injection valves are located inside the above region surrounded by the throttle bodies 10 that respectively connected to all of intake ports 9 as viewed in plan. Accordingly, a fuel supply line for supplying fuel to all of the fuel injection valves can be reduced in length and simplified in structure.

According to the third aspect of the present invention, all of the throttle valves can be driven by a single throttle driving motor. Accordingly, the structure of the throttle valve driving system can be simplified, and the cost therefor can be reduced.

According to the fourth aspect of the present invention, at least one throttle valve in the first bank is driven by the first throttle driving motor, and at least one throttle valve in the second bank is driven by the second throttle driving motor. Accordingly, at least one cylinder in either the first bank or the second bank can be put into an inoperative condition as required. Furthermore, the link for connecting the first throttle shaft and the second throttle shaft can be omitted to thereby simplify the connecting mechanism and to reduce the cost.

According to the fifth aspect of the present invention, at least one throttle valve in the first bank is driven by the first throttle driving motor, and at least two throttle valves in the second bank are individually driven by the respective second throttle driving motors. Accordingly, all of the cylinders can be individually put into an inoperative condition as required. Alternatively, the outputs from all of the cylinders can be individually controlled, thereby improving fuel economy.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
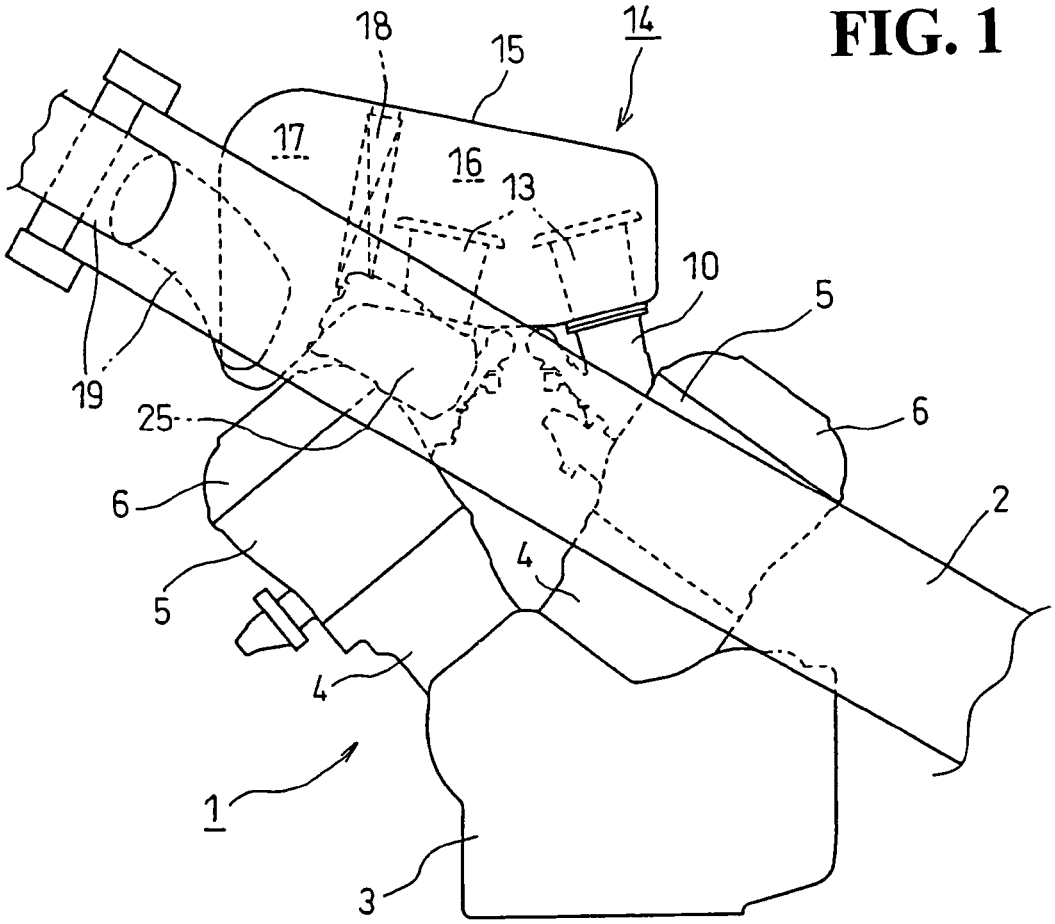
FIG. 1 is a side view of an essential part of a V-type internal combustion engine mounted on the main frames of a motorcycle.

The present invention will now be described in detail with reference to the accompanying drawings, wherein the same reference numerals will be used to identify the same or similar elements throughout the several views. It should be noted that the drawings should be viewed in the direction of orientation of the reference numerals.

A first preferred embodiment of the present invention will now be described with reference to FIGS. 1 to 6. Reference numeral 1 generally identifies a V-type internal combustion engine mounted on a motorcycle. The V-type internal combustion engine 1 is a longitudinal V-type four-cylinder internal combustion engine having a front bank and a rear bank. The V-type internal combustion engine 1 is fixedly mounted through brackets (not shown) or the like to a pair of right and left main frames 2 of the motorcycle. The V-type internal combustion engine 1 has a crankcase 3. A front train of two cylinders 4 form the front bank projecting obliquely upward from the crankcase 3 toward the front upper side thereof. A rear train of two cylinders 4 form the rear bank projecting obliquely upward from the crankcase 3 toward the rear upper side thereof. A front train of two cylinder heads 5 respectively joined to the front train of two cylinders 4. A rear train of two cylinder heads 5 are respectively joined to the rear train of the two cylinders 4. A front train of two head covers 6 are respectively joined to the front train of the two cylinder heads 5. A rear train of two head covers 6 are respectively joined to the rear train of the two cylinder heads 5.

Each cylinder 4 is formed with a cylinder bore 7. A piston 8 is slidably fitted in the cylinder bore 7 of each cylinder 4. The piston 8 is connected through a connecting rod (not shown) to a crankshaft (not shown) that extends in the transverse direction of the vehicle, so that the crankshaft is rotationally driven by the reciprocating motion of the piston 8 in each cylinder 4.

Each cylinder head 5 is formed with an intake port 9 exposed to the inside of the V-shaped space. Each cylinder head 5 is further formed with an exhaust port (not shown) opposite to the intake port 9 in the longitudinal direction of the vehicle. The intake port 9 has an upstream end, to which the downstream end of a throttle body 10, including a throttle valve 11, is connected. Reference numeral 14 identifies an air cleaner having a cleaner case 15. An intake pipe 13 extends through the wall of the cleaner case 15 of the air cleaner 14. The intake pipe 13 has a downstream end connected to the upstream end of the throttle valve 11.

The inside space of the cleaner case 15 of the air cleaner 14 is divided into a clean space 16 on the rear side and a dust space 17 on the front side by a cleaner element 18 substantially vertically mounted in the cleaner case 15. The upstream end of the intake pipe 13 opens into the clean space 16 in the cleaner case 15. The front portion of the cleaner case 15 is formed with a pair of right and left lower openings exposed to the dust space 17. The downstream ends of a pair of right and left air intake ducts 19 are respectively connected to the right and left lower openings of the front portion of the cleaner case 15. The upstream ends of the right and left air intake ducts 19 extend through the right and left main frames 2, and open into the space surrounded by a front cowl or a front cover (both not shown). Alternatively, the upstream ends of the right and left air intake ducts 19 may be exposed directly to the front side of the vehicle body.

Furthermore, a fuel injection valve 20 is mounted on the throttle body 10 so as to be located in the V-shaped space between the front and rear banks. The fuel injection valve 20 is pointed obliquely downward so that fuel is injected from the nozzle thereof toward the inner wall surface of the corresponding intake port 9.

Figure 5:
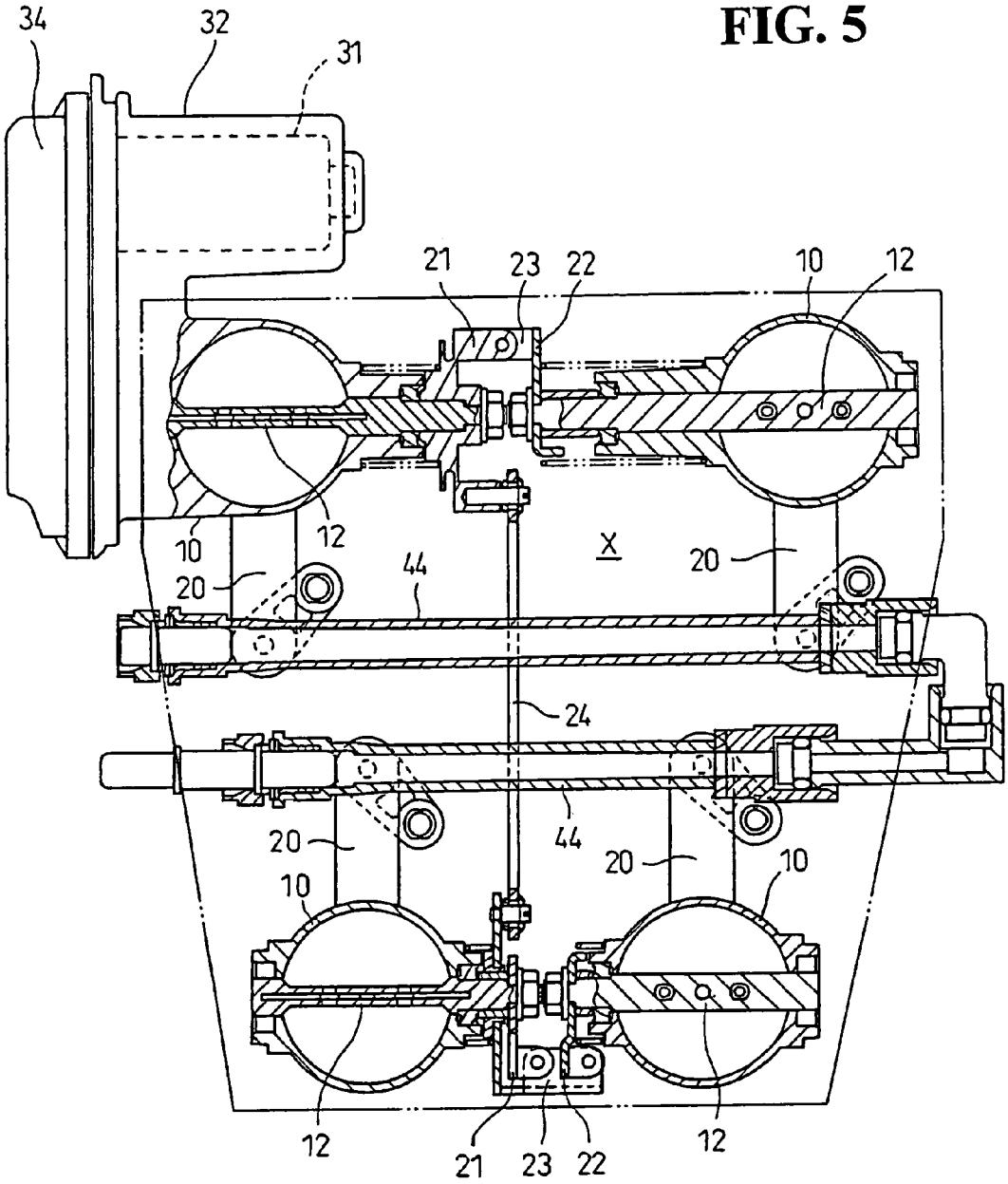
FIG. 5 is a sectional plan view of an essential part of a throttle valve driving force transmitting system.

As shown in FIG. 5, a pair of throttle shafts 12 for respectively supporting the two throttle valves 11 in each bank are aligned with each other. The pair of throttle shafts 12 in each bank are provided with radially projecting arms 21 and 22, which are connected together through a connecting member 23. The left arm 21 in the front bank is connected through a link 24 to the left arm 21 in the rear bank. Accordingly, all of the four throttle valves 11 are simultaneously rotated to obtain the same opening angle.

Figure 2:
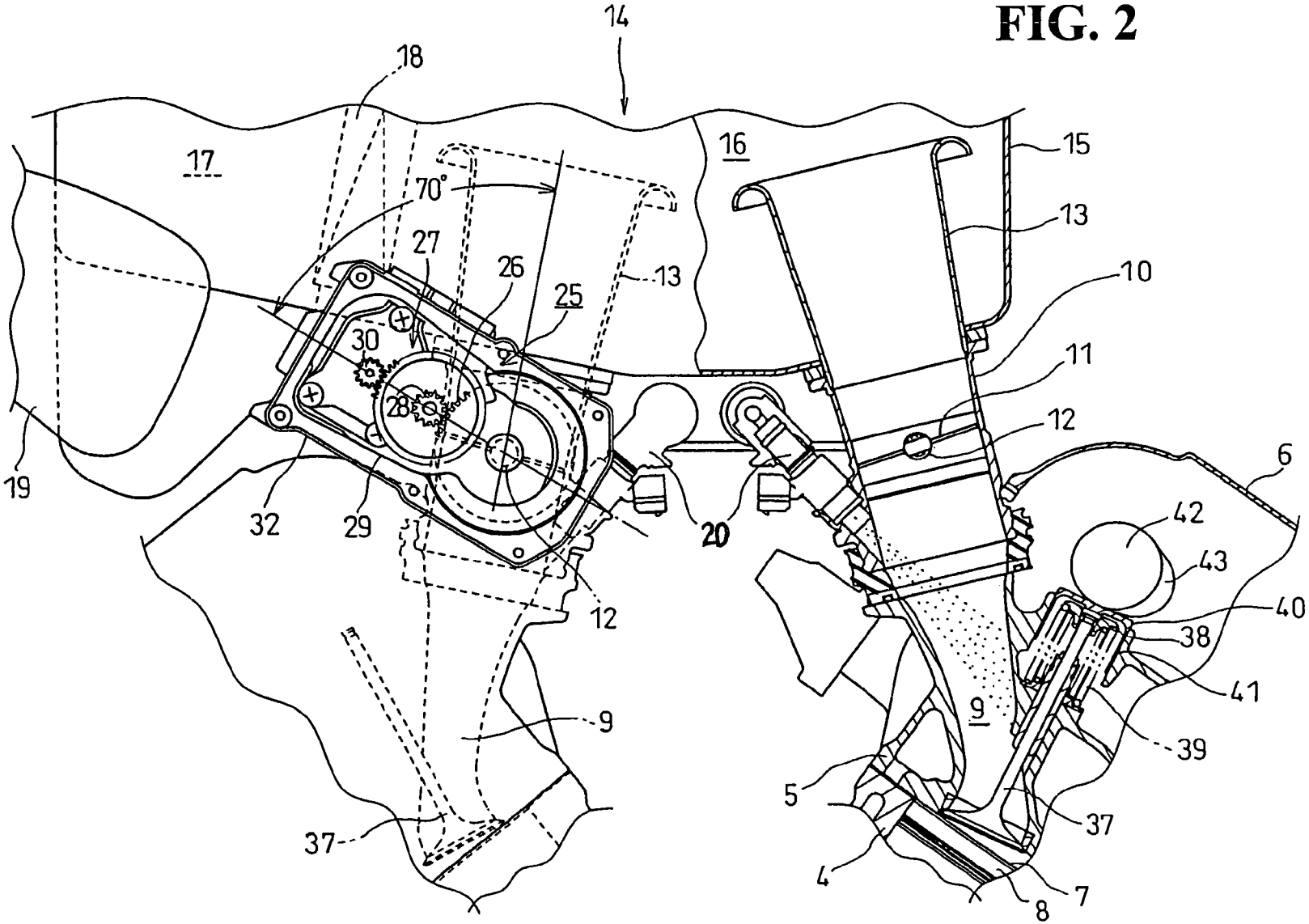
FIG. 2 is an enlarged view, partly in vertical section, of an essential part shown in FIG. 1.
Figure 3:
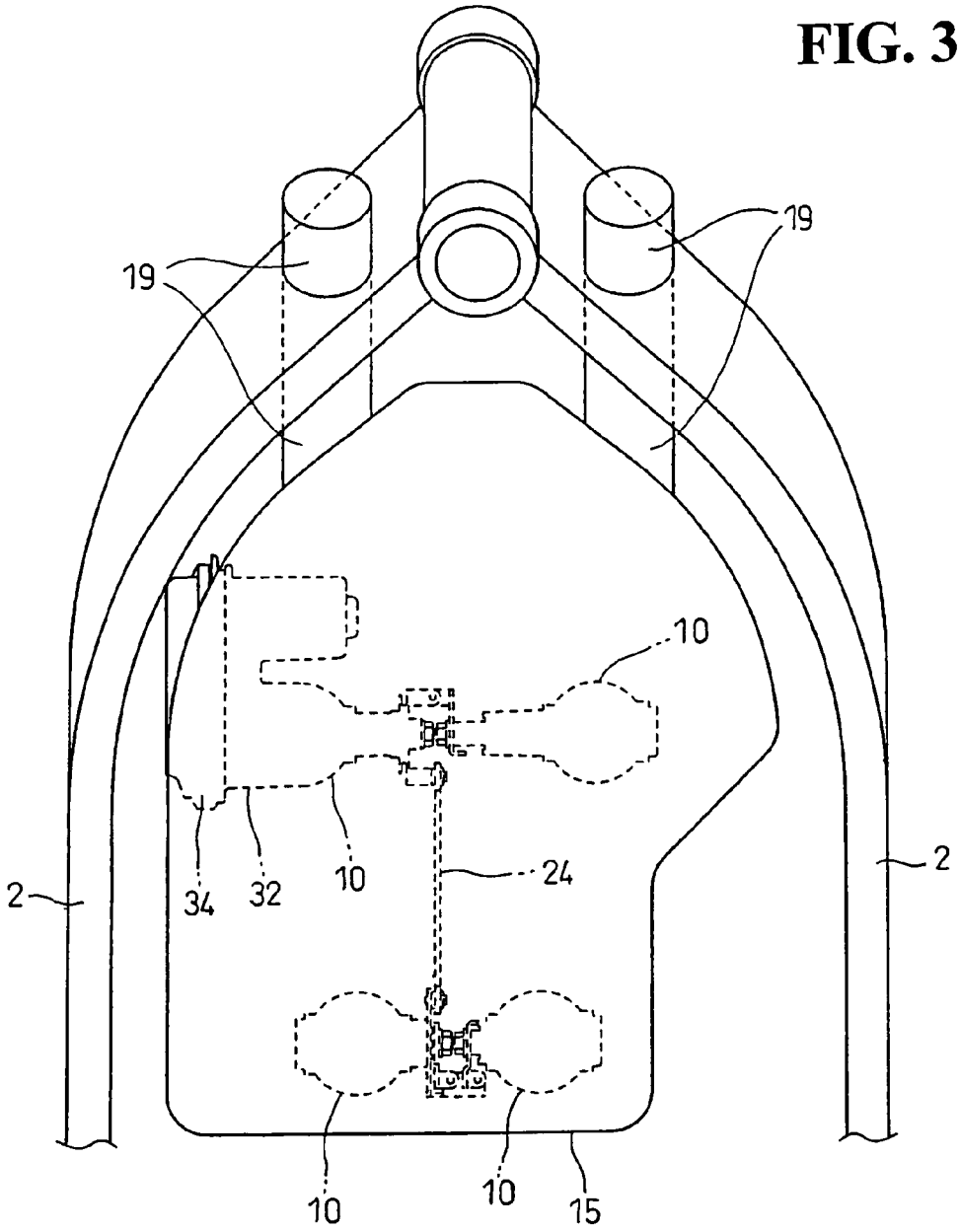
FIG. 3 is a top plan view of an essential part shown in FIG. 1.
Figure 4:
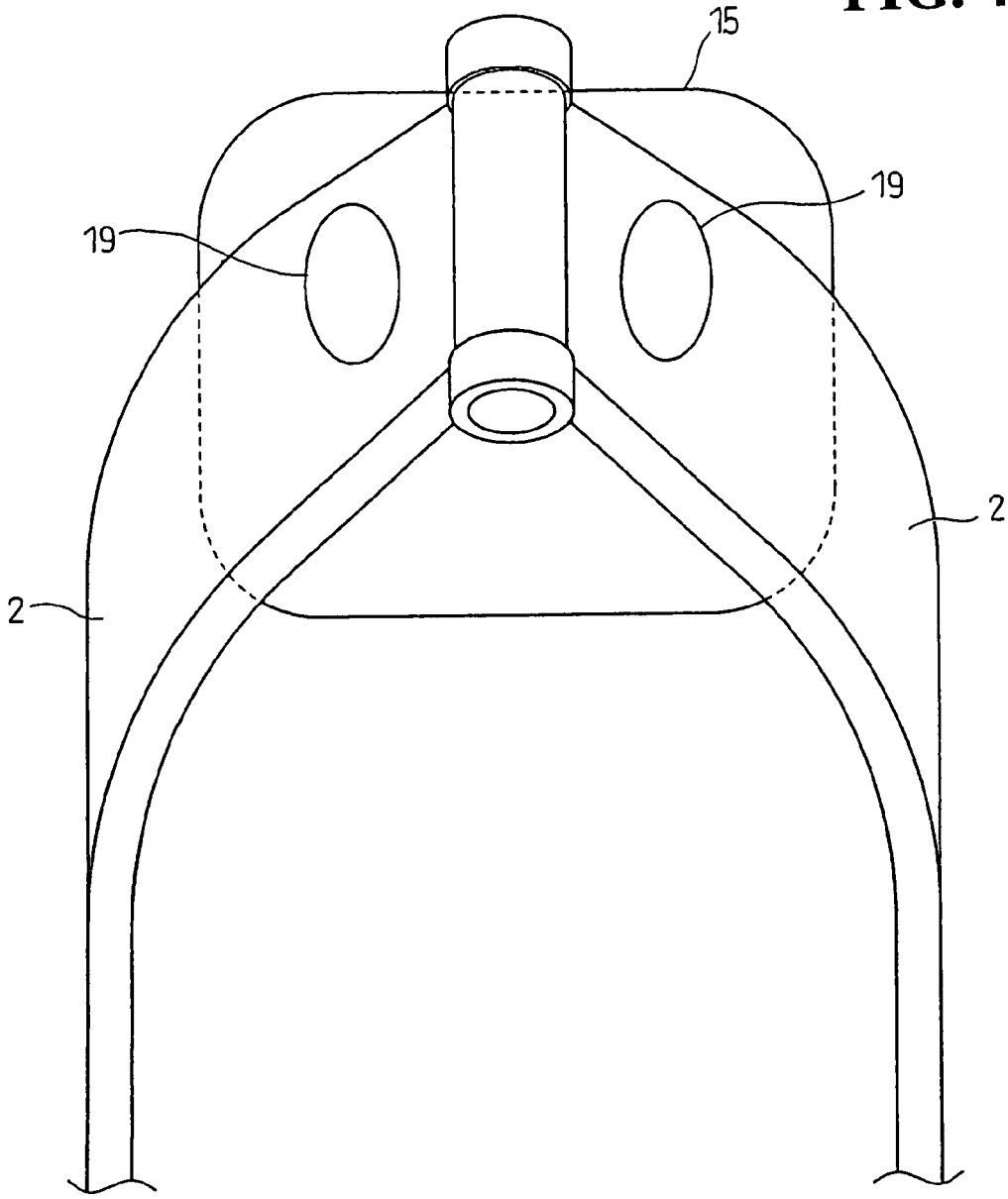
FIG. 4 is a front elevation of FIG. 3.
Figure 6:
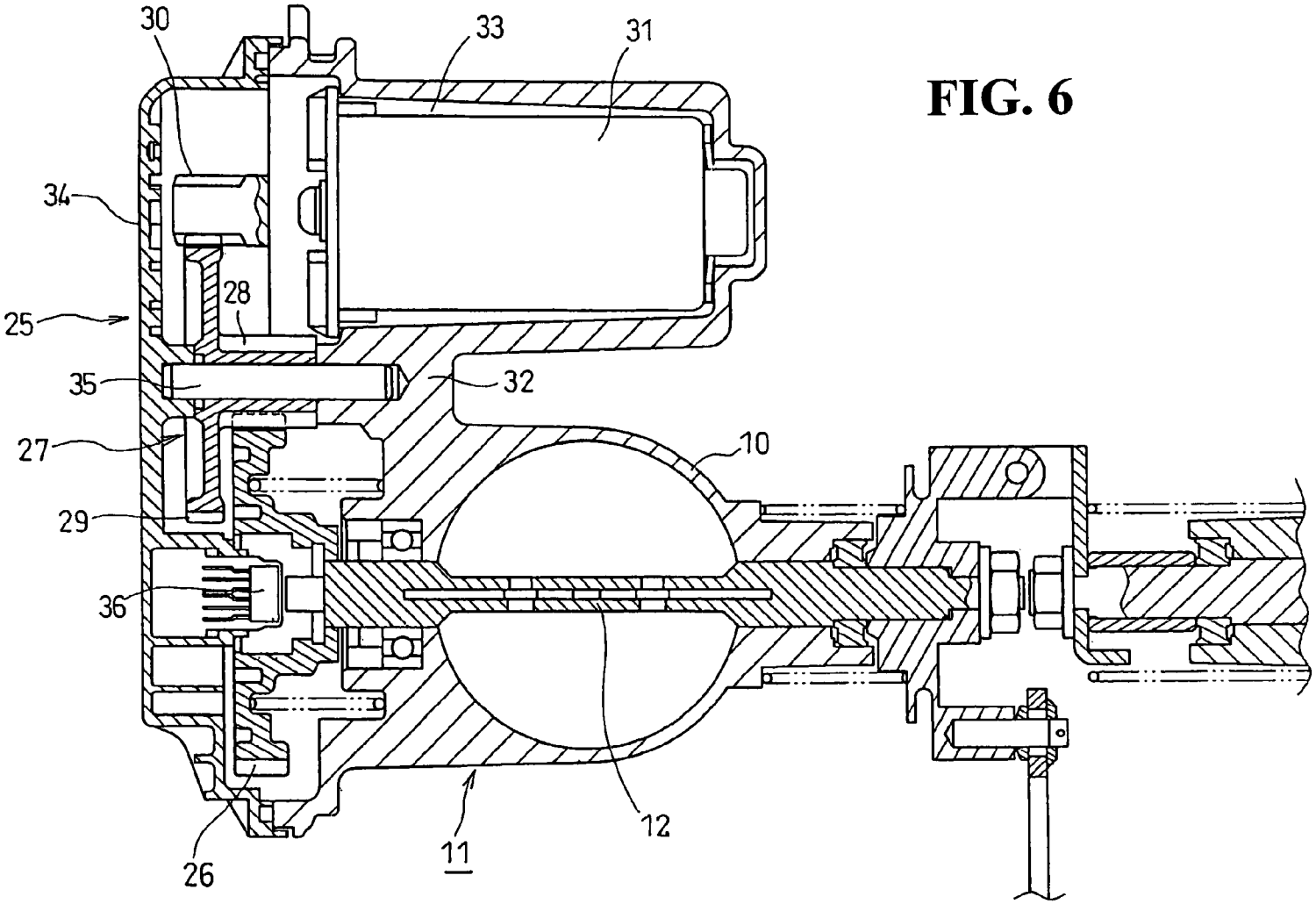
FIG. 6 is an enlarged sectional view of an essential part shown in FIG. 5.

As shown in FIG. 6, a throttle valve driving gear 26 is fixedly mounted on the left end portion of the throttle shaft 12. The throttle valve driving gear 26 is in mesh with the small-diameter gear 28 of the intermediate gear unit 27. The large-diameter gear 29 of the intermediate gear unit 27 is in mesh with an output gear 30 formed integrally with a drive shaft of the throttle driving motor 31. As shown in FIG. 2, the speed reducing mechanism 25, the center of the throttle valve driving gear 26, and the center of the output gear 30 are arranged in a line. Furthermore, the angle formed between this line of arrangement and the center line of the left throttle body 10 and the corresponding intake pipe 13 is set to about 70°. Accordingly, when the throttle driving motor 31 is operated, the throttle shaft 12 is rotated in a clockwise or counterclockwise direction to thereby open or close the corresponding throttle valve 11.

The throttle valve driving unit case 32 is formed integrally with the left throttle body 10 in the front bank. The throttle valve driving unit case 32 has a motor storing chamber 33 for storing the throttle driving motor 31. The shaft 35 for rotatably supporting the intermediate gear unit 27 has one end fixed in a hole formed on the throttle valve driving unit case 32 and the other end fixed in a hole formed on the unit case cover 34.

As shown in FIG. 5, which is a partially sectional, top plan view, the throttle driving motor 31 is located outside a region X shown by a double-dot & dash line that is surrounded by all of the four throttle bodies 10 that are respectively connected to all of the four cylinder ports 9.

A throttle grip (not shown) of the motorcycle is provided with a throttle operation sensor (not shown). On the other hand, a throttle position sensor 36 is located so as to face the left end of the throttle shaft 12 in the left arm 21 in the front bank. Although not shown, a throttle control device is provided to control the large-diameter gear 29 so that the difference between an output from the throttle operation sensor and an output from the throttle position sensor 36 becomes zero. Accordingly, when the throttle grip is operated in an accelerating or decelerating direction by the rider, the large-diameter gear 29 is operated according to a detection value output from the throttle operation sensor, so that all of the throttle valves 11 are controlled to an opening angle corresponding to the operation amount of the throttle grip.

As shown in FIG. 2, the downstream end of the intake port 9 for each cylinder 4 opens into the cylinder bore 7 of the cylinder 4. At the downstream end of the intake port 9, an intake valve 37 is operatively provided so as to open or close the intake port 9. A retainer 38 is fixed to the upper end of the intake valve 37. A spring seating portion is formed in the cylinder head 5. A valve spring 39 is interposed between the retainer 38 and the spring seating portion. A cylindrical valve lifter 40 is fixed to the upper end of the intake valve 37 so as to surround the retainer 38. A lifter guide 41 for slidably guiding the valve lifter 40 in the operating direction of the intake valve 37 is formed in the cylinder head 5. A camshaft 42 having an intake cam 43 is connected through a chain drive system to the crankshaft. The valve lifter 40 is pushed by the intake cam 43 to lift the intake valve 37, so that the intake valve 37 is operated according to a crank angle. Although not shown, an exhaust valve is similarly configured.

As shown in FIG. 5, a U-shaped fuel supply pipe 44 for supplying fuel to all of the four fuel injection valves 20 is provided in the V-shaped space between the front bank and the rear bank. One end of the U-shaped fuel supply pipe 44 is connected to an outlet of a fuel supply pump (not shown). The other end of the U-shaped fuel supply pipe 44 is connected to an inlet of the fuel supply pump. All of the fuel injection valves 20 are connected to the fuel supply pipe 44.

The preferred embodiment shown in FIGS. 1 to 6 is configured as mentioned above. When the V-type internal combustion engine 1 is operated to drive the vehicle, air is introduced from the front end openings of the air intake ducts 19 through the air intake ducts 19 into the dust space 17 of the cleaner case 15. The air thus introduced into the dust space 17 is filtered by the cleaner element 18 to enter the clean space 16. The clean air thus obtained is sucked from the four intake pipes 13 having openings in the clean space 16 into the respective throttle bodies 10.

When the throttle grip (not shown) is rotated to a required angle by the rider, this rotational angle is detected by the throttle operation sensor, and the throttle driving motor 31 is operated by an amount according to a detection signal output from the throttle operation sensor. Accordingly, all of the throttle valves 11 are simultaneously controlled to an opening angle according to the rotational angle of the throttle grip.

In the V-type internal combustion engine 1, each throttle body 10 is located in the V-shaped space between the front bank and the rear bank and is connected to the corresponding intake port 9 formed in the corresponding cylinder head 5. Accordingly, as shown in FIG. 2, the upstream ends of the intake pipes 13 connected to the upstream ends of the respective throttle bodies 10 are positioned close to each other, so that an increase in the size of the cleaner case 15 can be avoided.

The dust space 17 is formed on the front side of the cleaner space 16, and the downstream ends of the air intake ducts 19 are connected to the dust space 17. Furthermore, the right and left air intake ducts 19 respectively extend through the right and left main frames 2. The upstream ends of the air intake ducts 19 are pointed to the front side of the vehicle, so that the air flow associated with running of the vehicle can be smoothly introduced into the clean space 16 in the cleaner case 15.

Each fuel injection valve 20 is obliquely mounted to the corresponding throttle body 10 so as to be pointed toward the downstream side of the throttle body 10. Accordingly, fuel is injected from each fuel injection valve 20 toward the inner wall surface of the corresponding intake port 9 downstream of the corresponding throttle body 10, so that the fuel injected from each fuel injection valve 20 is sufficiently mixed with the intake air passing through the intake passage in the corresponding throttle body 10. Furthermore, the fuel deposited on the inner wall surface of the corresponding intake port 9 is exposed to the intake air passing through the intake passage in the corresponding throttle body 10, so that the amount of deposited fuel on the inner wall surface of the intake port 9 can be reduced to thereby improve the operation response of the V-type internal combustion engine 1.

The throttle driving motor 31 and the speed reducing mechanism 25 are located on the left side of the left throttle body 10 in the front bank of the V-type internal combustion engine. Accordingly, the maintenance of a throttle valve driving system (including the throttle driving motor 31 and the speed reducing mechanism 25) for driving all of the throttle valves 11 can be easily performed.

The axes of the reduction gears constituting the speed reducing mechanism 25 are arranged in a line at an angle of about 70° with respect to the center line of the left throttle body 10 and the associated intake pipe 13. Accordingly, the cleaner case 15 can be located close to the front head covers 6 of the V-type internal combustion engine 1 without a large interference with the throttle valve driving unit case 32, thereby reducing the overall size of the V-type internal combustion engine 1.

Furthermore, all of the four throttle valves 11 in the front and rear banks can be simultaneously operated by the single throttle driving motor 31, thereby simplifying the structure and reducing the cost.

Figure 7:
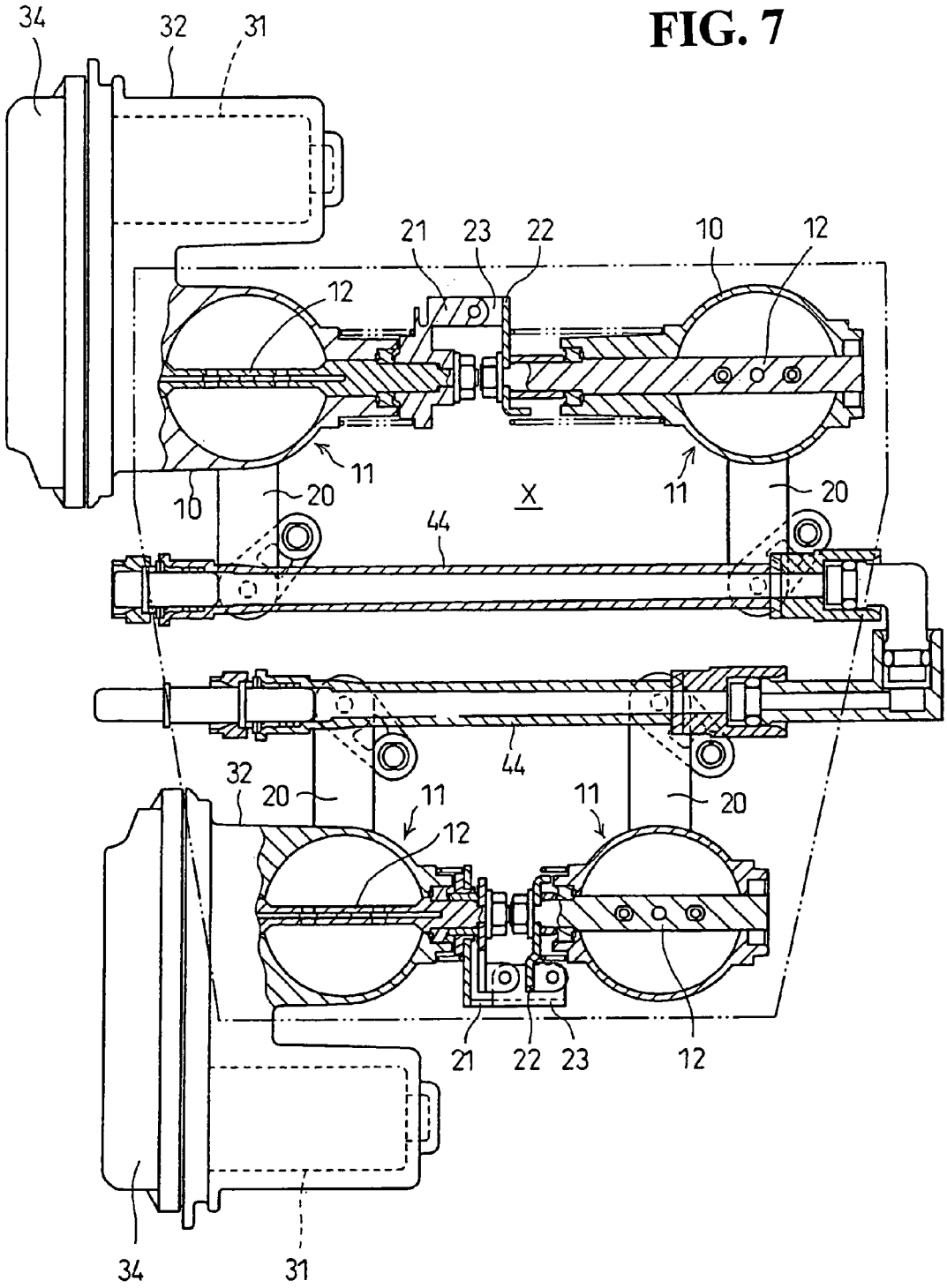
FIG. 7 is a sectional plan view of an essential part of a throttle valve driving force transmitting system, showing a second preferred embodiment of the present invention.

FIG. 7 shows a second preferred embodiment of the present invention. In the second preferred embodiment, two throttle driving motors 31 for respectively driving the two throttle valves 11 in the front bank and the two throttle valves 11 in the rear bank are located outside the region X surrounded by all of the four throttle bodies 10. With this configuration, either the front train of two cylinders 4 or the rear train of two cylinders 4 can be put into an inoperative condition as required.

Figure 8:
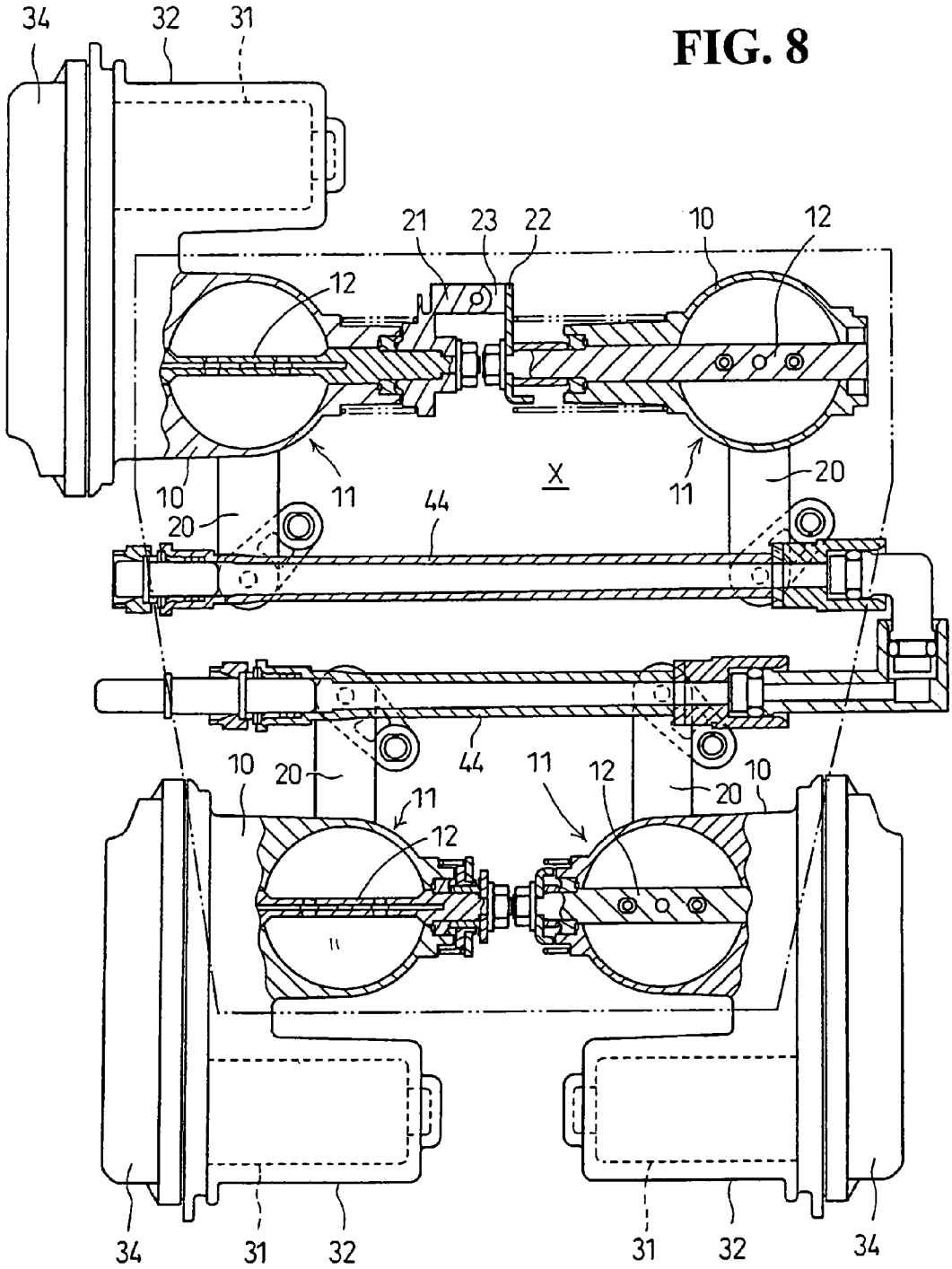
FIG. 8 is a sectional plan view of an essential part of a throttle valve driving force transmitting system, showing a third preferred embodiment of the present invention.

In the third preferred embodiment illustrated in FIG. 8, three throttle driving motors 31 for respectively driving the two throttle valves 11 in the front bank, the left throttle valve 11 in the rear bank, and the right throttle valve 11 in the rear bank are located outside the region X surrounded by all of the four throttle bodies 10. That is, the right and left throttle valves 11 in the front bank are connected together through the arms 21 and 22 and the connecting member 23, and are driven by one of the three throttle driving motors 31. However, the right and left throttle valves 11 in the rear bank are not connected with each other. They are respectively driven by the other two throttle driving motors 31. With this configuration, the two throttle valves 11 in the front bank, the left throttle valve 11 in the rear bank, and the right throttle valve 11 in the rear bank can be individually operated to thereby selectively put at least one of the four cylinders 4 into an inoperative condition as required. Alternatively, the opening angles of the throttle valves 11 in the front bank, the left throttle valve 11 in the rear bank, and the right throttle valve 11 in the rear bank can be individually controlled to thereby allow the operation of the V-type internal combustion engine 1 in an optimum condition.

Figure 9:
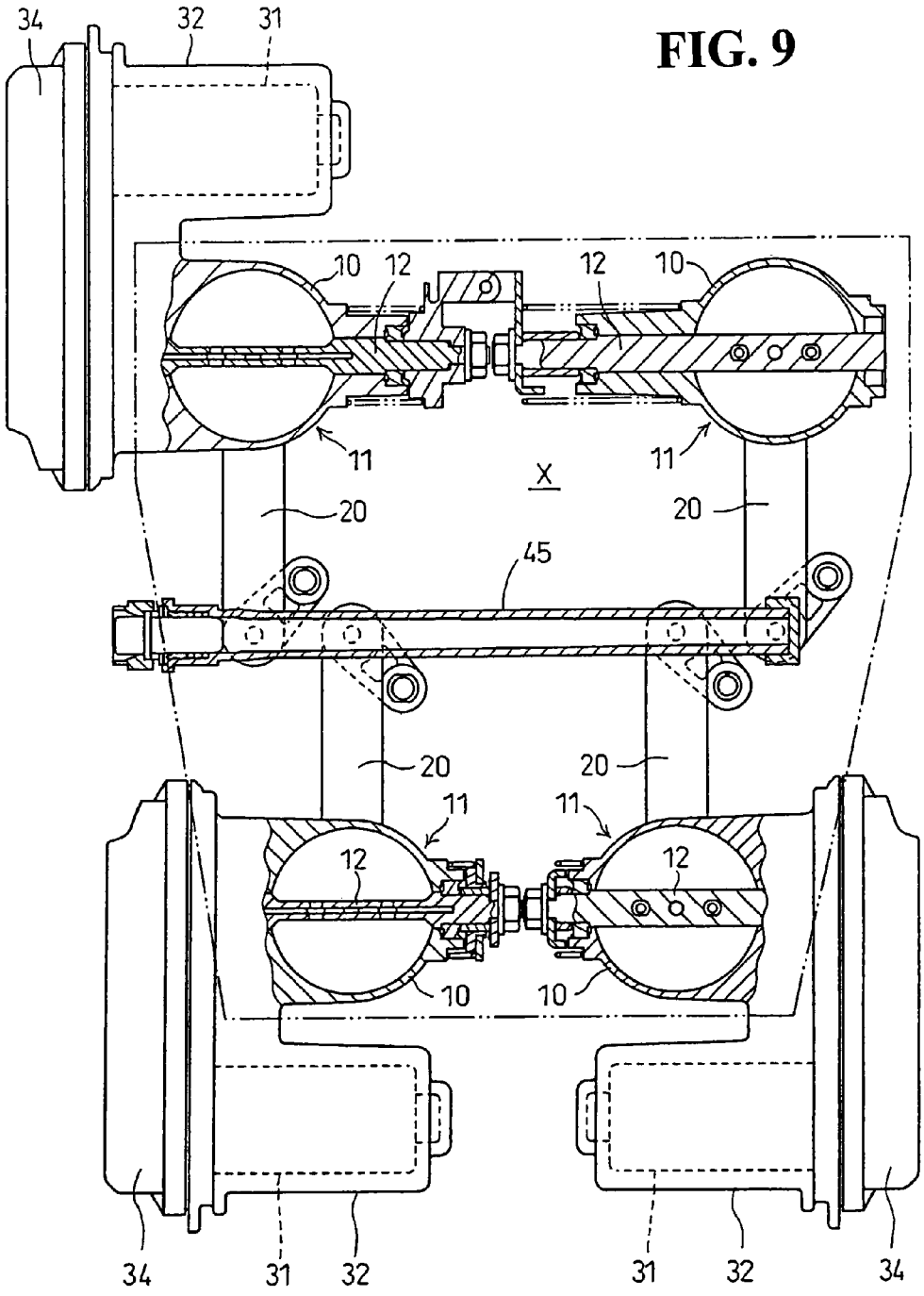
FIG. 9 is a sectional plan view of an essential part of a throttle valve driving force transmitting system, showing a fourth preferred embodiment of the present invention.

The fourth preferred embodiment illustrated in FIG. 9 is similar to the third preferred embodiment shown in FIG. 8, except that an I-shaped fuel supply pipe 45 is provided in place of the U-shaped fuel supply pipe 44, wherein the left end of the I-shaped fuel supply pipe 45 is connected to a fuel pump (not shown) and the right end of the I-shaped fuel supply pipe 45 is closed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electronic throttle control device in a V-type internal combustion engine for a vehicle, the V-type internal combustion engine having a fuel injection valve and throttle valves in an intake passage, said electronic throttle control device comprising:

a throttle driving motor for controlling an opening angle of each throttle valve according to an amount of operation of a throttle grip performed by an operator of the vehicle, wherein said throttle driving motor is located entirely outside of any region surrounded by a plurality of throttle bodies that are respectively connected to all intake ports of the engine as viewed in plan, wherein the throttle driving motor includes an output gear mounted thereon, a throttle shaft includes a throttle valve driving gear mounted thereon, and an intermediate gear unit including a plurality of intermediate gears operatively connecting the output gear and the throttle valve driving gear, and wherein an axis of the output gear, an axis of the throttle valve driving gear, an axis of each of the intermediate gears are located on a straight line.

2. The electronic throttle control device in the V-type internal combustion engine according to claim 1, wherein the fuel injection valves are located inside said region surrounded by the plurality of throttle bodies that are respectively connected to all intake ports as viewed in plan.

3. The electronic throttle control device in the V-type internal combustion engine according to claim 1, wherein said throttle driving motor comprises:

a single throttle driving motor connected to a first throttle shaft for supporting at least one of said throttle valves in a first bank, wherein said first throttle shaft is connected through a link to a second throttle shaft for supporting at least one of said throttle valves in a second bank.

4. The electronic throttle control device in the V-type internal combustion engine according to claim 1, wherein said throttle driving motor comprises:

a first throttle driving motor connected to a first throttle shaft for supporting at least one of said throttle valves in a first bank; and a second throttle driving motor connected to a second throttle shaft for supporting at least one of said throttle valves in a second bank.

5. The electronic throttle control device in the V-type internal combustion engine according to claim 1, wherein said throttle driving motor comprises:

a first throttle driving motor connected to a first throttle shaft for supporting at least one of said throttle valves in a first bank; and a plurality of second throttle driving motors respectively connected to a plurality of second throttle shafts for respectively supporting at least two of said throttle valves in a second bank.

6. The electronic throttle control device in the V-type internal combustion engine according to claim 1, wherein the straight line and a center line of one of the plurality of throttle bodies form an angle of approximately 70°.

7. The electronic throttle control device in the V-type internal combustion engine according to claim 1, further comprising a throttle valve driving unit case, wherein the throttle valve driving unit case has a motor storing chamber storing the throttle driving motor.

8. An electronic throttle control device in a V-type internal combustion engine, comprising:

a plurality of first throttle bodies in a first bank of throttle bodies, each of the plurality of first throttle bodies having a throttle valve and a fuel injection valve mounted therein;

a plurality of second throttle bodies in a second bank of throttle bodies, each of the plurality of second throttle bodies having a throttle valve and a fuel injection valve mounted therein;

a throttle driving motor for controlling an opening angle of each throttle valve according to an amount of operation of a throttle grip performed by an operator of the vehicle, wherein said throttle driving motor is located entirely outside of any region surrounded by an outer circumference of said first and second throttle bodies as viewed in plan, wherein the throttle driving motor includes an output gear mounted thereon, a throttle shaft includes a throttle valve driving gear mounted thereon, and an intermediate gear unit including a plurality of intermediate gears operatively connecting the output gear and the throttle valve driving gear, and wherein an axis of the output gear, an axis of the throttle valve driving gear, an axis of each of the intermediate gears are located on a straight line.

9. The electronic throttle control device in the V-type internal combustion engine according to claim 8, wherein the fuel injection valves are located inside said region as viewed in plan.

10. The electronic throttle control device in the V-type internal combustion engine according to claim 8, wherein said throttle driving motor comprises:

a single throttle driving motor connected to a first throttle shaft for supporting at least one of said throttle valves in said first bank, wherein said first throttle shaft is connected through a link to a second throttle shaft for supporting at least one of said throttle valves in said second bank.

11. The electronic throttle control device in the V-type internal combustion engine according to claim 8, wherein said throttle driving motor comprises:

a first throttle driving motor connected to a first throttle shaft for supporting at least one of said throttle valves in said first bank; and a second throttle driving motor connected to a second throttle shaft for supporting at least one of said throttle valves in said second bank.

12. The electronic throttle control device in the V-type internal combustion engine according to claim 8, wherein said throttle driving motor comprises:

a first throttle driving motor connected to a first throttle shaft for supporting at least one of said throttle valves in said first bank; and a plurality of second throttle driving motors respectively connected to a plurality of second throttle shafts for respectively supporting at least two of said throttle valves in said second bank.

13. The electronic throttle control device in the V-type internal combustion engine according to claim 8, wherein the straight line and a center line of one of the plurality of first and second throttle bodies form an angle of approximately 70°.

14. The electronic throttle control device in the V-type internal combustion engine according to claim 8, wherein said first and second plurality of throttle bodies are four throttle bodies in total, and said region is a generally polygonal shaped region formed by the outer circumference of the four throttle bodies, and wherein said throttle driving motor is located outside of said polygonal shaped region as viewed in plan.

15. The electronic throttle control device in the V-type internal combustion engine according to claim 8, further comprising a throttle valve driving unit case, wherein the throttle valve driving unit case has a motor storing chamber storing the throttle driving motor.

* * * * *